US010400393B2

(12) United States Patent
Hawén

(10) Patent No.: US 10,400,393 B2
(45) Date of Patent: Sep. 3, 2019

(54) REFINER

(71) Applicant: Valmet AB, Sundsvall (SE)

(72) Inventor: Anders Hawén, Tyresö (SE)

(73) Assignee: Valmet AB (SE)

( * ) Notice: Subject to any disclaimer, the term of this patent is extended or adjusted under 35 U.S.C. 154(b) by 446 days.

(21) Appl. No.: 15/117,576

(22) PCT Filed: Dec. 23, 2014

(86) PCT No.: PCT/SE2014/051574

§ 371 (c)(1),
(2) Date: Aug. 9, 2016

(87) PCT Pub. No.: WO2015/119549

PCT Pub. Date: Aug. 13, 2015

(65) Prior Publication Data

US 2016/0355977 A1 Dec. 8, 2016

(30) Foreign Application Priority Data

Feb. 10, 2014 (SE) ..... 1450141

(51) Int. Cl.
*B02C 7/02* (2006.01)
*B02C 7/11* (2006.01)
(Continued)

(52) U.S. Cl.
CPC ..... *D21D 1/30* (2013.01); *B02C 7/02* (2013.01); *B02C 7/06* (2013.01); *B02C 7/12* (2013.01);
(Continued)

(58) Field of Classification Search
CPC ..... D21D 1/30; D21D 1/303; D21D 1/306; D21D 1/00; D21D 1/22; B02C 7/02;
(Continued)

(56) References Cited

U.S. PATENT DOCUMENTS 1,431,422 A 10/1922 Randecker
2,807,889 A 10/1957 Dunkelman
(Continued)

FOREIGN PATENT DOCUMENTS

WO 2009040477 A1 4/2009
WO 2009097963 A2 8/2009

OTHER PUBLICATIONS

International Search Report for Application No. PCT/SE2014/051574 dated May 18, 2015.

*Primary Examiner* — Shelley M Self
*Assistant Examiner* — Katie L. Parr
(74) *Attorney, Agent, or Firm* — Lerner, David, Littenberg, Krumholz & Mentlik, LLP

(57) ABSTRACT

A refiner is disclosed comprising relatively rotatable inner and outer conical refining blades. The refining blades are coaxially arranged around a symmetry axis and are provided with first bars and second bars, respectively, for the grinding of fibrous material. The inner conical refining blade or any of the first bars of the inner conical refining blade extend further along the symmetry axis, in the direction of the tapering of the inner and outer conical refining blades, than the outer conical refining blade or any of the second bars of the counter conical refining blade.

9 Claims, 7 Drawing Sheets

(51) Int. Cl.

| | |
|---|---|
| ***D21D 1/26*** | (2006.01) |
| ***D21D 1/30*** | (2006.01) |
| ***B02C 7/06*** | (2006.01) |
| ***D21D 1/20*** | (2006.01) |
| ***B02C 7/12*** | (2006.01) |
| ***D21D 1/22*** | (2006.01) |
| ***D21D 1/24*** | (2006.01) |

(52) U.S. Cl.
CPC ..... *D21D 1/20* (2013.01); *D21D 1/22* (2013.01); *D21D 1/24* (2013.01); *D21D 1/26* (2013.01); *D21D 1/303* (2013.01); *D21D 1/306* (2013.01)

(58) Field of Classification Search
CPC .... B02C 7/06; B02C 7/11; B02C 7/12; B02C 23/00; B02C 23/02; B02C 23/08; B02C 13/06; D21B 1/26
USPC .... 241/261, 261.1, 261.2, 261.3, 244, 282.1
See application file for complete search history.

(56) References Cited

U.S. PATENT DOCUMENTS

| | | | | | |
|---|---|---|---|---|---|
| 2,807,989 | A * | 10/1957 | Schaan | D21D 1/22 | 241/102 |
| 3,144,994 | A | 8/1964 | Danforth | | |
| 3,506,202 | A | 4/1970 | Cumpston, Jr. | | |
| 3,589,630 | A * | 6/1971 | Danforth | D21D 1/22 | 241/260 |
| 5,152,871 | A | 10/1992 | Gullichsen | | |
| 8,109,452 | B2 * | 2/2012 | Akisada | A61L 9/14 | 239/67 |

* cited by examiner

PRIOR ART

REFINER

CROSS-REFERENCE TO RELATED PATENT APPLICATIONS

The present application is a national phase entry under 35 U.S.C. § 371 of International Application No. PCT/SE2014/051574 filed Dec. 23, 2014, published in English, which claims priority from Swedish Application No. 1450141-5 filed Feb. 10, 2014, all of which are incorporated herein by reference.

TECHNICAL FIELD

The present invention relates in general to refiners, more specifically it relates to refiners provided with conically shaped refining blades.

BACKGROUND

Refiners can be used to mechanically process fiber containing materials such as biomass. Refiners come in a variety of different designs where each design is tailored for particular purposes. A common feature for quite a few of these designs is that fibrous material is fed through an inlet, such as a feeding channel, in the refiner to arrive at a refining area in which the material is processed, i.e. ground by means of refining blades. These refining blades also come with different designs and a variety of different geometrical shapes. The refining blades might for example be of a disc shape type where the refining surfaces of the refining blades extend more or less perpendicular to the inlet. One particular version of such a design comprises two axially aligned refining blades that are linearly displaced along a common axis that is more or less parallel with the material inlet. The grinding surfaces, or the refining surfaces, of the refining blades will in this particular design be facing each other. The area between the refining blades defines a refining gap. In a typical case one of the two refining blades will be attached to, for example, an end portion of a material feeding axis and comprise a centrally located through hole through which the material is fed into the refining area. Upon entrance into the grinding area the material will be brought into contact with the surfaces of the refining blades. The refining blades are provided in the refiner in such a way that they can be rotated around an axis. By rotating the refining blades the material present in the refining gap will be ground between the refining surfaces before leaving the grinding area. The described refining blades might be separately rotatable, often in such a way that they could be rotated in opposite directions. It is however also possible that only one of the refining blades is rotatable while the other remains fixed. In this particular design the rotating refining blade is referred to as a rotor while the fixed, static refining blade is referred to as a stator.

There also exist refiners where the refining blades have a conical shape. In this particular design two conically shaped refining blades are arranged coaxially around a common axis of rotational symmetry. The outer larger conically shaped refining blade has an inner surface opposing an outer surface of the inner smaller conically shaped refining blade. The gap between these opposing surfaces constitutes the refining gap and during operation the material to be processed is directed into this gap and ground between the two surfaces.

To obtain a more efficient grinding action, it is possible to provide the refining surfaces of the refining blades with bars. These bars consist of surface structures such as grooves placed side by side with protruding bars of metal or other hard materials of various geometrical shapes. The bars are provided to further increase the effectiveness of the refining and/or to provide certain specified desirable effects. A possible form of bars as used in a refiner with conically shaped rotors and stators is given in WO 2009/040477 A1. Another type of refining blades is disclosed in WO 2009/097963 A2. Both of these disclosures relate solely to choosing shapes for bars so as to obtain an effective refining of the pulp.

During operation of a refiner with conically shaped refining blades, fibrous material is fed through an inlet such as a feeding channel and thus enters the grinding area. Normally the material will enter the refining area in a direction that is more or less parallel to the symmetry axis of the conically shaped refining blades. The material is then directed into the area that define the refining gap between the grinding surfaces of the refining blades and brought into contact with the bars. Since the bars are more or less delicate surface structures protruding from the grinding surface they are slightly vulnerable to damages. It might for example be the case that the material fed into the refiner carries debris with it. In the case of dispersion of pulp the debris could, for example, be stones or steel remnants from the equipment used to cut the tree. It could also be remaining pieces of wire such as those used when packing the material into bales. Another common type of debris when dispersing pulp emanates from solid remnants in recycled cardboard or paper. This could for example be clips used in a cardboard box, but it could literally be any type of debris present in recycled cardboard or paper. All solid objects present in the material to be ground in the refiner could potentially damage the bars of the refining blades. Beside the fact that such debris in itself might severely damage the bars, there is also a potential risk that a bar of a refining blade, when damaged by debris, will be broken off from the refining blade and cause further damages to neighboring bars, thus creating a cascade of damaging debris that will cause further damages to the refining blades A known measure taken in order to at least partially prohibit debris from entering a refiner is to wash the material before it is processed by the refiner. Even though this is a rather effective means to remove a substantial part of the debris there is still a risk that solid objects will enter the refiner. If, despite the washing, debris do enter the refiner it is usually relied upon gravity to prohibit the debris from contacting the refining blades. That is, the intention is that solid objects contained in the material even after washing will sink towards the bottom of the refining zone before the material is brought into contact with the refining blades. The effectiveness of this particular solution is however dependent upon the concentration of the material, that is the amount of water or fluid in the material mixture. It should be noted that even in applications where the concentration is rather low, that is, when the fibrous material contains a lot of water or some other fluids, the material might still carry debris with it and bring it into contact with the refining blades. This might, for example, be the case if the feeding velocity of the material is high whereby the debris is swiftly transported to the refiner blades before it has had time to sink to the bottom of the refining zone.

The refining blades with their corresponding surface structures, that is the bars, are in general quite expensive and delicate to construct and debris present in the pulp therefore constitute a nuisance within the technical field, a nuisance that might lead to severe refiner damages and, as a consequence, to expensive and prolonged shutdowns of the refining process. The present invention is designed to at least partially mitigate the problems related to debris damaging the refining blades of a refiner.

SUMMARY

One object of the present invention is to provide a refiner with conically shaped refining blades that at least mitigates the risks that debris or solid material contained in the material to be processed damages the refining blades or the bars of the refining blades.

Another object of the invention is to provide an attachable conical refining blade that can be fitted to, and used with, existing refiner designs. This refining blade is designed to mitigate the risks that debris or solid carried in the processing material will damage the refiner or negatively affect the operation of the refiner.

Yet another object of the invention is to provide a pair of conical refining blades that can be fitted to, and used with, existing refiners. The refining blade pair is designed to reduce the risks that debris or solid materials present in the material to be processed enters the refining area.

According to a first general aspect there is provided a refiner comprising relatively rotatable inner and outer conical refining blades. The refining blades being coaxially arranged around a symmetry axis and being provided with first bars and second bars, respectively, for grinding of fibrous material. The inner conical refining blade or any of the first bars of the inner conical refining blade extends further along the symmetry axis, in the direction of the tapering of the inner and outer conical refining blades, than the outer conical refining blade or any of the second bars of the outer conical refining blade.

According to a second general aspect there is provided an attachable conical refining blade for a refiner, wherein the refiner comprises an outer conical refining blade provided with second bars. The attachable refining blade is provided with first bars and is configured to be rotatable and coaxially arranged with the outer conical refining blade along a symmetry axis in such a way that it forms an inner conical refining blade. The attachable refining blade or any the bars of the attachable conical refining blade, when coaxially arranged with the outer conical refining blade, extends further along the symmetry axis, in the direction of the tapering of the conical refining blades, than the outer conical refining blade or the bars of the outer conical refining blade.

According to a third general aspect there is provided a pair of conical refining blades for use in a refiner, wherein the pair of refining blades are configured to be coaxially arranged along a symmetry axis to define an inner and an outer conical refining blade and wherein the refining blades are provided with first and second bars, respectively, for grinding of fibrous material. At least a subset of the first bars provided on the inner conical refining blade extends further along the symmetry axis in the direction of the tapering of the conical refining blades than the second bars provided on the outer conical refining blade.

Further objects and advantages of the present design will be given in what follows.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the drawings, the same reference numbers are used for similar or corresponding elements.

In what follows we will mainly describe the technology with reference to the processing of fibrous material such as pulp. Fibrous materials includes lignocellulosic materials and various fiber containing biomass. A particular type of lignocellulosic material is pulp. Pulp is normally obtained by chemically or mechanically separating cellulose fibers from wood, fiber crops or waste paper. Other types of fiber containing material that can be processed by the present refiner includes material such as tobacco, cotton as well as other biomass such as meat.

Figure 1:
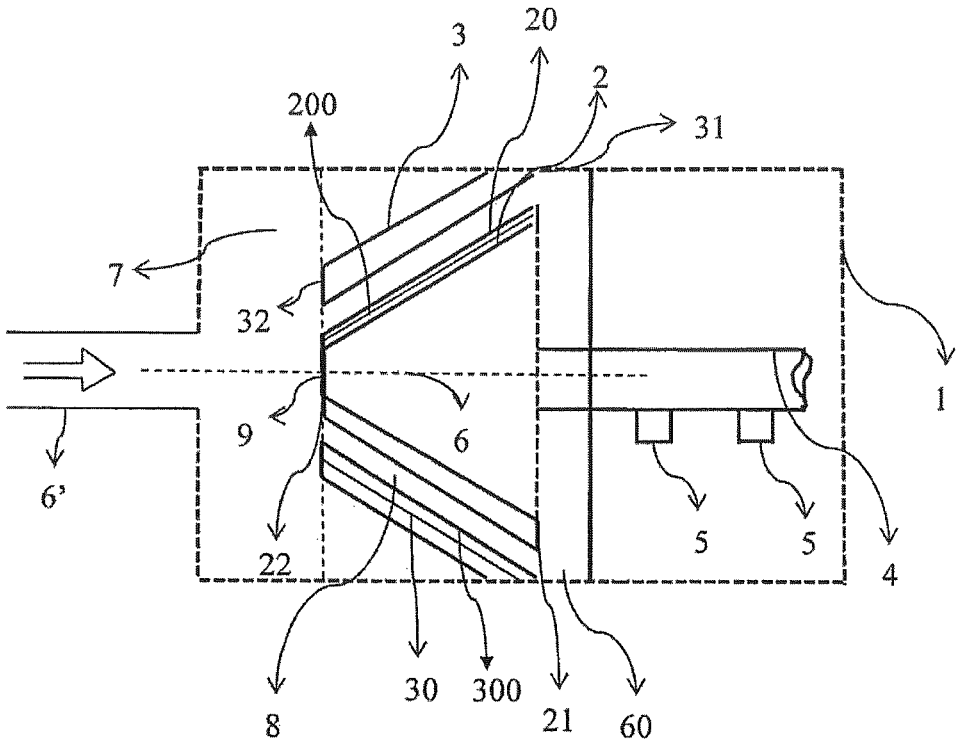
FIG. 1 is a schematic drawing of a cross-section of a known refiner.

Since the operation of a known refiner is similar to the use of a refiner according to the present invention a detailed description of the former will be given first. In FIG. 1 there is shown a schematic cross-section of a refiner 1 with conically shaped refining blades. The refining blades, of which refining blade 2 defines an inner conically shaped refining blade and refining blade 3 defines an outer conically shaped refining blade, are enclosed in a casing 1 that represents the remaining structure of the refiner. The remaining structure comprises among other well-known components a driving means, such as an electrical motor or a hydraulic device, for rotating the inner 3 and outer 2 refining blades around a more or less common rotational symmetry axis 6. As can be inferred from FIG. 1, the inner 2 and outer 3 refining blades are coaxially arranged around the axis 6 in such a way that their respective symmetry axis falls on said axis 6. Furthermore, the conically shaped refining blades 2, 3 in the figure have the form of truncated cones, or equivalently as frusto-conically shaped refining blades or as cones having their tips removed. In other words they have a tapered surface shape extending from a base section 21, 31 at the large end of the respective cones towards a truncated narrow ends 22, 32 of the respective cones. As shown in the picture, the truncated top sections 22, 32 of the conically shaped blades 2, 3 lies in essentially the same plane, perpendicular to the symmetry axis. Notwithstanding the fact that the refining blades are shaped as truncated cones the term conically shaped refining blades will be used throughout the description as it is a commonly used term within the technological field.

Both of the conically shaped refining blades comprises refining surfaces. For the inner refining blade 2 the refining surface 20 lies on the outside of the cone, as defined by the radial direction, while the refining surface 30 of the outer refining blade lies on the inside of the cone, as defined by the radial direction. Here the radial direction is given by a polar coordinate system whose origin coincides with the symmetry axis of the inner 2 and outer 3 refining blades. The radial distance between the two refining surfaces defines the refining gap 8. In the embodiment shown in FIG. 1 the outer refining blade 3 is held fixed in the refiner 1. Usually such a refining blade is referred to as a stator. The inner refining blade 2 is however rotatable arranged around the symmetry axis 6. Such a rotatable refining blade is often referred to as a rotor. The base section 21 of the inner refining blade is rotatable mounted to a shaft 4 arranged on bearings 5. The shaft 4 is connected to driving means, not shown, that are configured to rotate the shaft to thereby impart a rotation of the refining blade 2 around the symmetry axis 6. The device might also contain means that are configured to translate the shaft 4 with the attached inner refining blade 2 along the symmetry axis 6. In this way it will be possible to alter the width of the refining gap 8. The means for translating the shaft 4 could be an electrical motor or a hydraulic device.

The inner 2 and outer 3 refining blades in FIG. 1 are provided with bars 200 and 300, respectively. The bars are protruding structures of various geometrical shapes arranged on the refining surfaces 20, 30, respectively of the refining blades. These structures typically consist of a multitude of hard protruding bars with adjacent grooves extending along the refining surfaces from the base section 21, 31 of the cones towards the top section 22, 32 of the cones. The bars could be manufactured from some hard material, such as metal, and attached to the refining surfaces. They could also be molded together with the conically shaped refining blades in a way that provides a one-piece structure. It is also possible that they could be grooves milled from the refining surfaces. The purpose of these bars is to enable the refining action of the refining blades. Alternatively, legobits-like stories make out a hall in a base and simply fix the bars in the sphere.

During operation of the refiner, fibrous material such as pulp is fed into the refiner through a feeding channel 6'. The pulp feeding direction is in FIG. 1 depicted as being parallel with the rotational axis, so that the pulp enters zone 7 with a flow direction that is essentially parallel with the rotational symmetry axis 6 of the conically shaped refining blades. When the pulp reaches zone 7 in a direction essentially parallel to the rotation axis 6, it will mainly fall on the center plate 9. As pulp continues to flow into zone 7, the pulp will be pushed outwards in the radial direction and brought into contact with the bars 200, 300 arranged at the truncated part, or narrow end, 22, 32 of the conically shaped refining blades 2, 3. This contact with the bars will steer the pulp into the refining gap 8. The continuous flow of pulp into the zone 7 will push the pulp upwards along the refining surfaces 20, 30 of the refining blades 2, 3. Finally the refined pulp will leave the refining gap 8 by means of an outlet 60 arranged in proximity to the base sections 21, 31 of the refining blades 2, 3. Here it is clear that the cooperative action of the bars provided at the truncated part of the conically shaped refining blades steers the pulp into the refining gap 8.

The refiner according to the description relating to FIG. 1 comprises the features of a known refiner with conically shaped refining blades. This refiner is however susceptible for the aforementioned potential risk that debris carried in the fibrous material will enter the refining gap 8 and damage the refining blades 2, 3. That is, debris contained in the fibrous material will, when fed towards the refining gap, be brought into contact with the refining blades 2, 3 and steered into the refining gap 8. This might, as has been explained earlier, lead to damages to the refining blades 2, 3.

According to the aspects given in the summary, the proposed solution to the problem of debris in the material is to have the inner conically shaped refining blade 2, or any of the bars 200 provided on the inner conically shaped blade 2, extend further along the common symmetry axis 6, in the direction of the tapered cone defined by the shape of the refining blades, than the corresponding outer conically shaped refining blade 3, or the bars 300 provided on the outer conically shaped refining blade 3.

Since the inner refining blade 2 or the bars 200, or a subset of the bars 200, of the inner refining blade 2, extends further along the common symmetry axis 6, in the direction of the tapered cone defined by the shape of the refining blades, than the outer refining blade 3 or the bars 300 of the outer refining blade 3, the debris, when approaching the refining blades, will be brought in contact with the rotating inner refining blade 2 or the bars 200 of the inner refining blade 2 first. The contact between the debris and the rotating refining blade will impart a substantial impulse to the debris that will knock the debris out of its initial path and send it in a tangential direction to the rotation. Since the outer refining blade, or the bars of the outer refining blade, is shorter than the corresponding inner refining blade or corresponding bars they will generally not obstruct this directional change of the debris. In this way the debris will be prevented from entering the refining gap between the conically shaped refining blades while the less solid fibrous material is allowed to enter the refining gap.

The proposed refiner may preferably be used to refine fibrous material such as pulp having a low to medium concentration, i.e. about 1-15%, that is fibrous material that contain 85-99% water or some other suitable liquid. Even though these level constitutes rather viscous mixings, the mixings are still fluid enough to not be negatively affected by the bars in the proposed design. The material is therefore allowed to enter the refining gap and be processed between the conically shaped refining blades. Hence, a refiner according to the proposed design will actively prevent solid materials in the form of debris from entering the refining gap while at the same time allowing the fibrous material entrance into the refining gap.

To further improve the understanding and appreciation of the inventive concept a more detailed description of various embodiments will be given where reference is made to the enclosed drawings.

Figure 2:
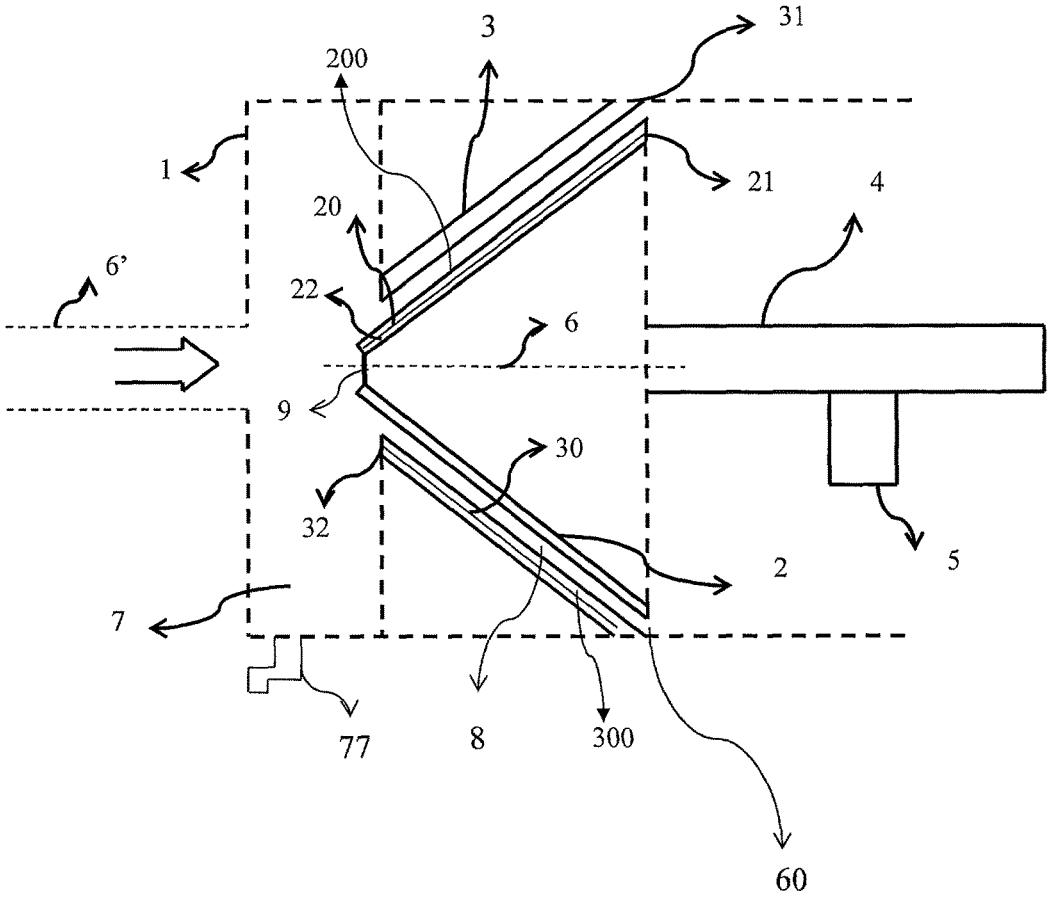
FIG. 2 is a schematic drawing of a cross-section of an embodiment of a refiner according to the present invention.

FIG. 2 illustrates an exemplary embodiment of the present invention. This embodiment provides an illustration showing that the inner refining blade 2, or the bars 200 of the inner refining blade 2, extends further in the direction of the tapering of the cone defined by the conical refining blades, or equivalently in the direction towards the narrow end of the conical refining blades, than the corresponding outer refining blade 3, or the bars 300 of the outer refining blade 3.

During use of a refiner as shown in FIG. 2, potential debris contained in the fibrous material will be brought in contact with the inner refining blade 2, or the bars 200 of the inner refining blade 2, first. The rotational motion of the inner refining blade 2 will, upon contact with the debris, knock the debris out of its initial path and back towards zone 7. In this way the inner refining blade 2 or the bars 200 will act as an active preventing means for preventing debris from entering the refining gap 8 and cause potential damage to the inner 2 and outer 3 refining blades. This protective feature will continue during the whole operation of the refiner and the debris will repeatedly be knocked back towards zone 7. When the refining process is completed or temporarily stopped, the debris can be removed from zone 7.

In more detail FIG. 2 shows an alternative version of the refiner described in relation to FIG. 1. The refiner embodiment illustrated in FIG. 2 comprises a conically shaped inner refining blade 2 provided with bars 200. The bars 200 are arranged on the surface of the inner refining blade 2 facing the refining gap 8. The bars 200 are provided along a direction extending from a base section 21 at the larger end of the cone towards the narrow end 22 of the cone. The bars 200 could also be provided in the form of sections or bands 210 of protruding bars with adjacent grooves arranged around the periphery of the cone or they could be grooves milled out of the material that constitutes the cone. A particular purpose of having sections or bands 210 is to make it easier to replace the innermost band of bars 200. Since the bars in the innermost band acts to prevent debris from entering the refining gap they might get damaged more frequently than bars provided in other bands. By providing bars in sections or bands it will only be necessary to replace the innermost band if the bars 200 of that band get damaged. Another version might be constructed by creating grooves in the refining blade and attach bars to those grooves. It is also possible that the cone and the bars is a one-piece structure, that is, they are molded together. In one embodiment the bars are provided along the whole length of the surface. In any case the bars are protruding surface structures adapted to enable the refining action of the refining blade. At the narrow end of the cone the bars 200 could have a curved shaped to provide a steering means for directing the pulp into the refining gap 8.

The embodiment illustrated in FIG. 2 also comprises a conically shaped outer refining blade 3. The refining blade 3 is provided with bars 300 arranged on the surface of the cone that is facing the refining gap 8. The bars are provided along a direction extending from a base section 31 at the larger end of the cone towards the truncated part, or narrow end, 32 of the cone. As in the case of the bars 200 of the inner refining blade 2 the bars 300 could be provided in the form of sections or bands 310 of protruding bars arranged on the surface of the cone or they could be grooves milled out of the material that constitutes the cone. Another possibility is to create grooves in the conical shaped refining blade and attach bars to these grooves. It is also possible that the conically shaped outer refining blade 3 and the bars 300 is a one-piece structure, that is, they are molded together. In one particular embodiment the bars 300 are provided along the whole length of the surface of the outer refining blade 3.

In the embodiment schematically shown in FIG. 2 at least a subset of the bars 200 of the inner refining blade 2 extends further into the zone 7 than the outer end of the refining blade or the corresponding ends of the bars 300 of the outer refining blade 3. That is, when the inner and outer refining blades are coaxially arranged around a common symmetry axis 6, the ends of at least a subset of the bars 200 of the inner refining blade 2 extends further along the symmetry axis 6, in the direction of the tapered cones or, equivalently, the truncated narrow ends of the cones, as defined by the respective refining blades 2, 3, than does the outer refining blade 3 or the bars 300 of the outer refining blade 3. This particular construction of the bars of the respective refining blades provides for an improvement with regard to prohibiting debris present in the pulp from entering the refining gap 8.

In an alternative embodiment it is instead the inner shaped refining blade 2 that extends further along the symmetry axis 6, in the direction of the tapering of the cones or, equivalently, in the direction towards the truncated narrow ends of the cones, as defined by the respective refining blades 2, 3, than does the outer refining blade or the bars 300 of the outer refining blade. In this way it is not necessary to provide the inner refining blade with bars on the part of the surface closest to the narrow end 22 of the cone. Instead the surface of the refining blade itself hits the debris and knocks it away before it enters the refining gap 8. In the cases where the inner refining blade 2 is made from a softer material than the bars 200 it might be necessary to strengthen the conical refining blade by dressing the surface area closest to the narrow end of the cone with a harder material to thereby avoid damages to the surface. The purpose of the extended bars 200 or the extended conically shaped inner refining blade 2 is that they should extend further into zone 7 of the refiner than the corresponding parts of the outer refining blade to thereby ensure that parts of the inner conically shaped refining blade 2 are brought in contact with potential debris first. In this way they can provide a good protection from debris entering the refining gap. The mechanism that is utilized to prevent the debris from entering the refining gap 8 is the same as for the extended bars 200 and will be described below.

During operation of the proposed refiner, the inner refining blade 2 are coaxially arranged with the outer refining blade 3 around a rotational symmetry axis 6. The refining surface 20 of the inner refining blade is thus spaced from, and facing, the refining surface 30 of the outer refining blade so that a refining gap 8 is defined between these surfaces. The larger end of the conically shaped inner refining blade 2 is attached directly or indirectly to a shaft 4 arranged on bearings 5. The shaft is connected to an electrical motor or some other driving means, such as a hydraulic device, that is configured to rotate the shaft around the symmetry axis 6. The same or some other driving means is used to translate the shaft in a direction along the symmetry axis 6. Since the inner refining blade 2 is attached to the shaft 4, the electrical motor(s) is adapted to impart a rotation and translation of the inner refining blade 2 around and along the symmetry axis 6. Thus initially the inner refining blade 2 is translated along the symmetry axis 6 so that it becomes coaxially arranged with the fixed outer refining blade 3. In this way a refining gap 8 between the inner 2 and outer 3 refining blade is created. When the refining process starts, the fibrous material is fed into zone 7, enclosed by casing 1, through a feeding channel. The material will flow on to the center plate 9 and the continuous inflow will push the material outwards towards the inner refining blade 2. As material continue to flow into zone 7, it is forced into the area surrounding the tip of the bars 200 of the inner refining blade 2 or the inner refining element 2. Eventual debris in the fibrous material will, upon contact, be hit by the rotating bars 200 or the innermost end of the inner refining blade and momentum will be transferred to the debris which in turn will change the direction of the debris and knock it back towards zone 7, thus effectively preventing debris from entering the refining gap 8 between the inner 2 and outer 3 refining blades. Since neither the outer refining blade 3 or the bars 300 of the outer refining blade 3 protrudes as far into zone 7 as does the inner refining blade 2 or the bars 200 of the inner refining blade 2, they will not affect the directional change of the debris.

Moreover, since the fibrous material in most applications have a low to medium concentration its motion towards the refining gap 8 will not be negatively affected and the material will therefore be allowed to enter refining gap 8 to be further processed by the refining blades 2, 3. Finally the processed material will leave the refiner through an outlet 60 provided in a location close to the base section 21, 31 of the conically shaped refining blades 2, 3.

In the embodiment described relating to FIG. 2, and all other described embodiments, zone 7 might be provided with a closeable drainage 77 that collect debris from zone 7. The collected debris might be removed after the material refining operation has been completed or temporarily shut down.

In the embodiment described with reference to FIG. 2, the outer refining blade 3 was held fixed in the refiner while the inner refining blade 2 was arranged to be rotatable around the symmetry axis 6. This is however not a necessary feature. Instead, the outer refining blade 3 could be rotatable around the symmetry axis 6. In this way another type of relative rotational motion between the inner 2 and outer 3 refining blades is obtained. The rotational direction of the refining blades could be opposite each other but they could also be arranged to rotate in the same direction. They could share a common rotational shaft 4, in the case that they rotate in the same direction, but they could also be attached to different shafts to thereby provide for a refiner with oppositely rotating conically shaped and coaxially arranged refining blades 2, 3. The rotation could be actuated by means of the same electrical motor or hydraulic device but it is also possible that the rotations are driven by separate electrical motors and hydraulic devices.

In the refiner embodiment described in relation to FIG. 2, the feeding channel 6', could be provided essentially parallel with the symmetry axis 6 of the coaxially arranged refining blades, that is, the symmetry axis 6 could essentially coincide with the feeding direction of the fibrous material. In other words, the inlet of the feeding channel 6', through which the fibrous material enters zone 7 in the refiner, might preferable be positioned so that it is essentially facing the center plate 9. In this way the fibrous material will flow towards the center plate 9 in a direction more or less parallel with the symmetry axis 6. By providing the inlet in this way the material will be distributed symmetrically around the symmetry axis 6 which, in turn, will yield a more symmetrical distribution of material in the refining gap 8.

Figure 3A:
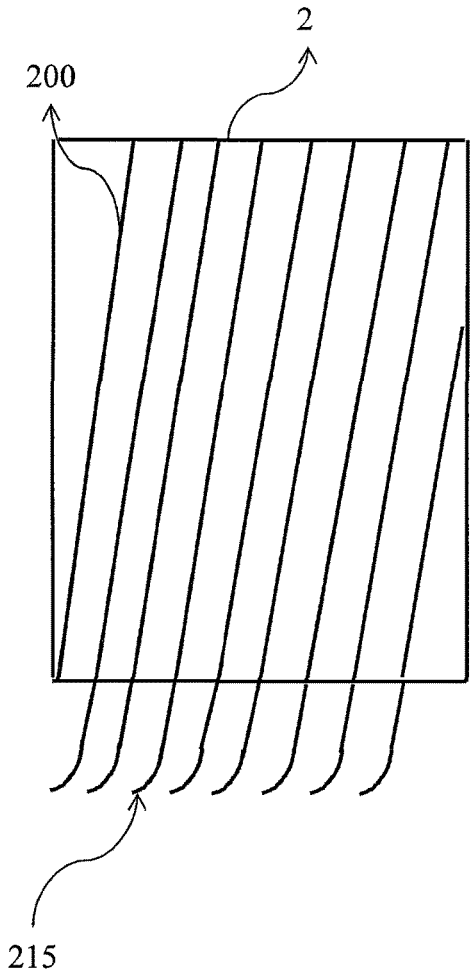
FIG. 3*a* is a schematic drawing of an embodiment of the bars on an inner conical refining blade according to the present invention.
Figure 3B:
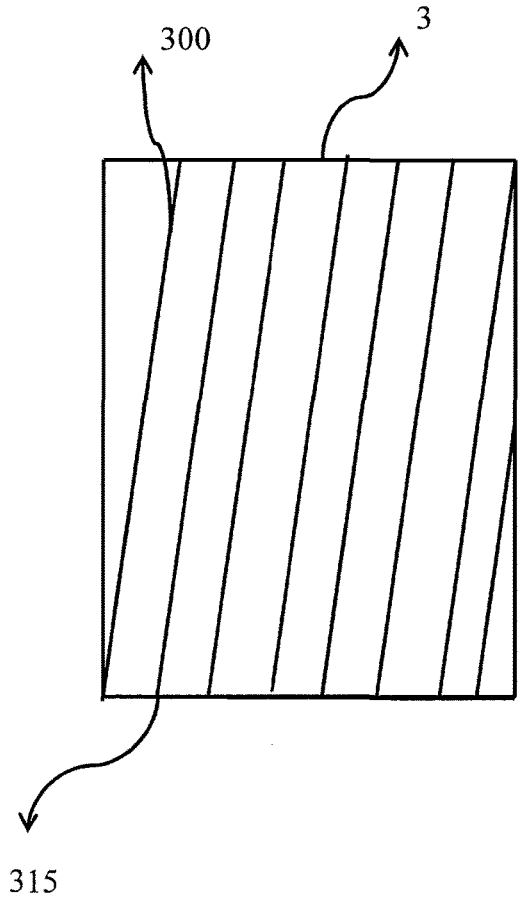
FIG. 3*b* is a schematic drawing of an embodiment showing the bars on an outer conical refining blade according to the present invention.

FIG. 3*a* shows in some detail a possible design for the bars 200 of the inner refining blade 2. FIG. 3*b* on the other hand shows in some detail a possible design for the bars 300 of the outer refining blade 3 to be used in the same refiner.

A comparison between FIGS. 3*a* and 3*b* shows that the bars 200 of the inner refining blade 2 extends further in the direction of the tapering of the cone than the bars 300 of the outer refining blade 3. It is also schematically shown how the inner most ends 215 of the bars 200, in the direction of the tapering of the conical refining blade 2 have been given a curved shape to facilitate the steering of the material into the refining gap 8. Even though it is not shown in FIG. 3*b* the same curved shape could be used for the inner ends 315 on the bars 300 to further enhance the steering action.

Figure 4:
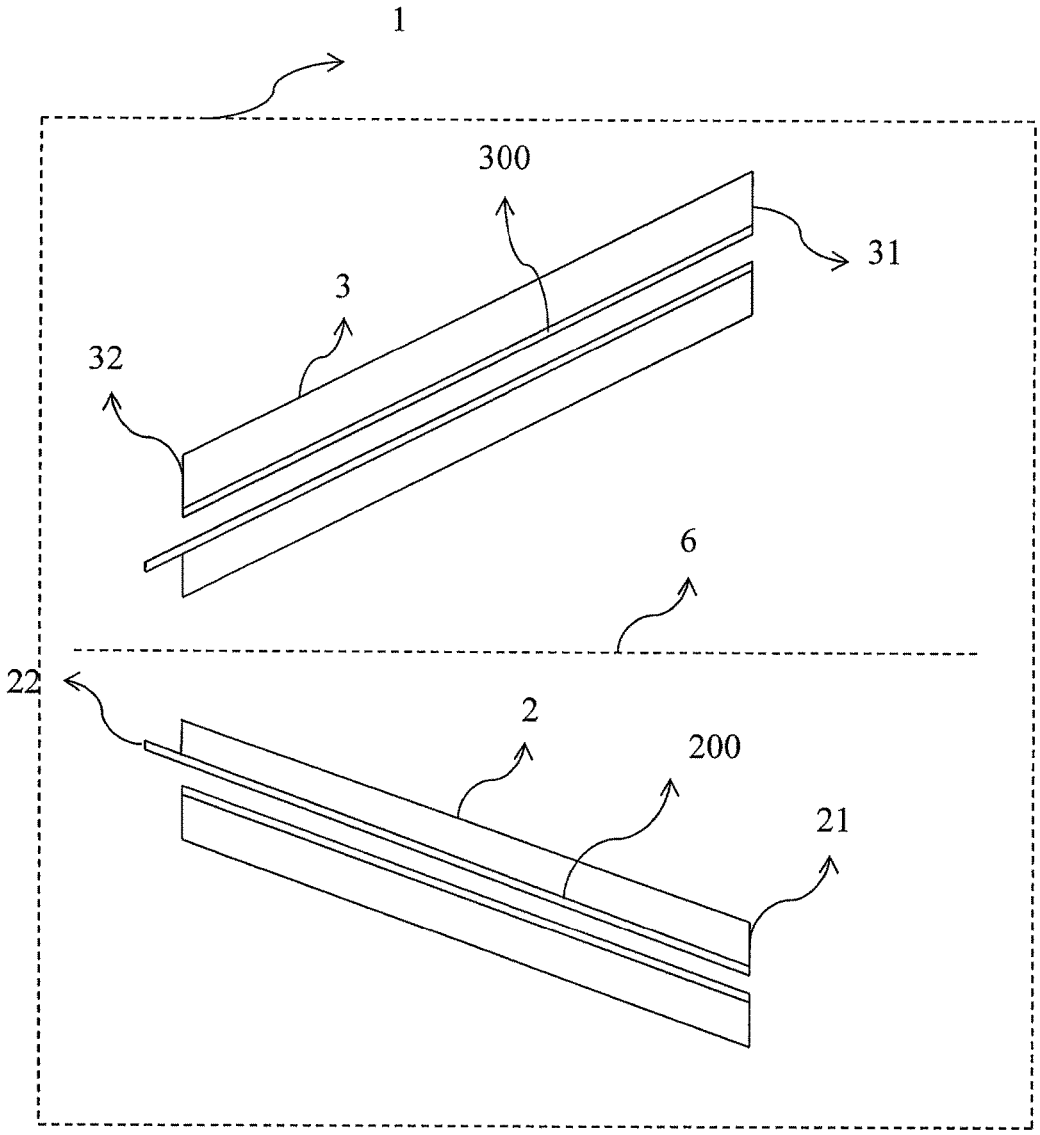
FIG. 4 is a schematic drawing of a cross-section of an embodiment of a pair of conically shaped refining blades for a refiner.

In FIG. 4 there is shown a cross-section of a pair of conically shaped refining blades 2, 3 coaxially arranged around a common symmetry axis 6. The arrangement of refining blades is ready to be used in a refiner. In one embodiment the outer refining blade 3 constitutes a refining structure already provided in the refiner while the inner refining blade 2 is an attachable refining blade that is configured to be coaxially arranged with the aforementioned outer refining blade 3 and rotatable mounted to a shaft 4 in the refiner. The refining blade 2 is in a particular embodiment provided with bars 200 that, when the refining blade 2 is attached and ready to be used, extends further along the symmetry axis 6, in the direction of the tapering of the cone than the outer fixed conical refining blade 3 or the bars 300 thereof. FIG. 4 illustrates this particular feature by showing that the truncated narrow end 22 of the bars 200 of the inner refining blade 2 extends further than the end truncated narrow 32 of the outer refining blade 3. A refining blade according to these embodiments can be added to existing refiners intended to be used with conically shaped refining blades without the need to alter the operational construction of the refiner.

Figure 5:
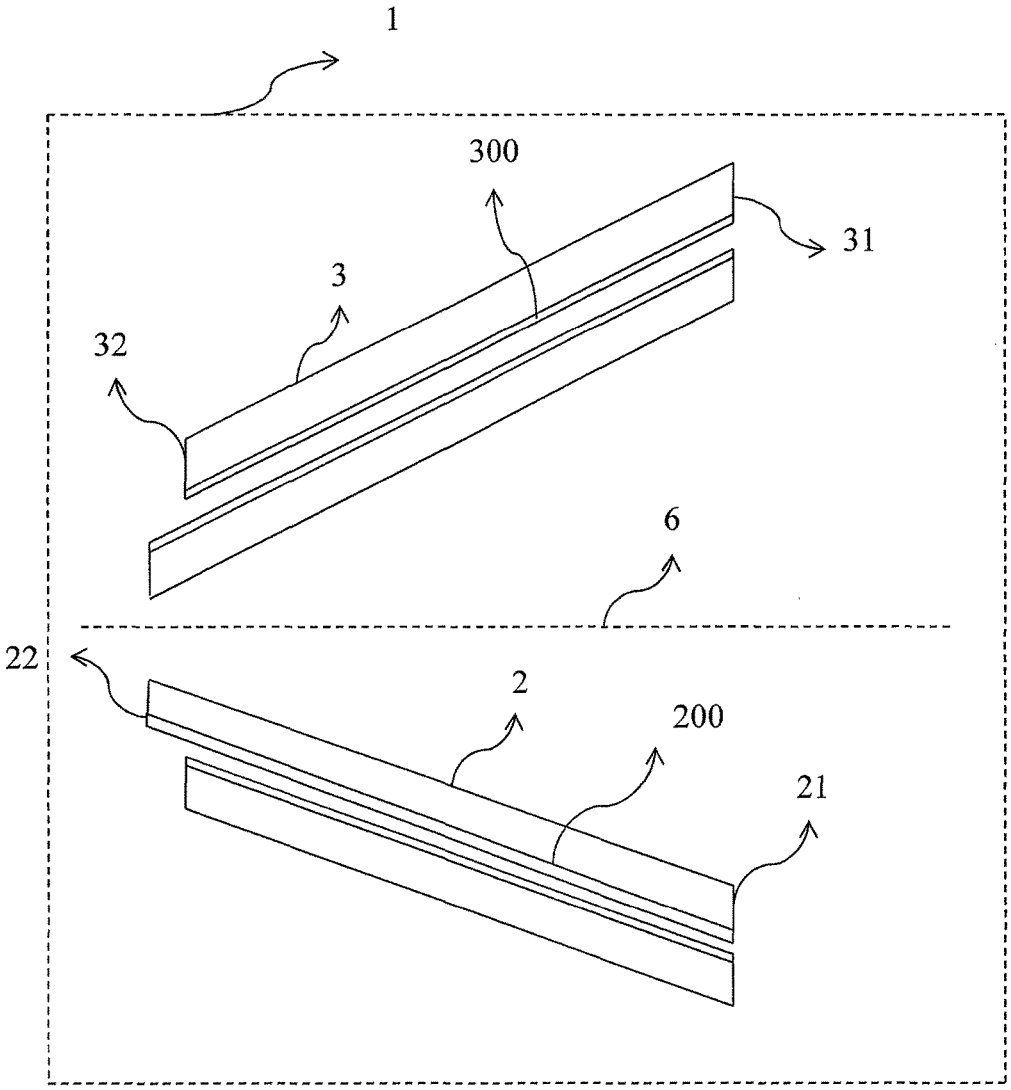
FIG. 5 is a schematic drawing of a cross-section of an alternative embodiment of conically shaped refining blades for a refiner.

FIG. 5 illustrates another possible embodiment of a refiner where the inner conically shaped refining blade 2 extends further along the symmetry axis 6, in the direction of the tapering of the cone than the outer fixed conical refining blade 3 or the bars 300 thereof. This particular embodiment provides an alternative to the case where the bars 200 of the inner conically shaped refining element extends further along the symmetry axis 6, in the direction of the tapering of the cone than the outer fixed conical refining blade 3 or the bars 300 thereof. In FIG. 5 the bars 200 extends along the whole surface of the inner refining blade 2. It is however possible that the bars 200 ends before they reach the endpoint 22 of the inner refining blade 2. In this latter embodiment the inner conical refining blade 2 will act to prevent debris from entering the refining gap 8. It is also shown that the bars 300 of the outer refining blade 3 extends along the whole surface of the outer refining blade.

Figure 6:
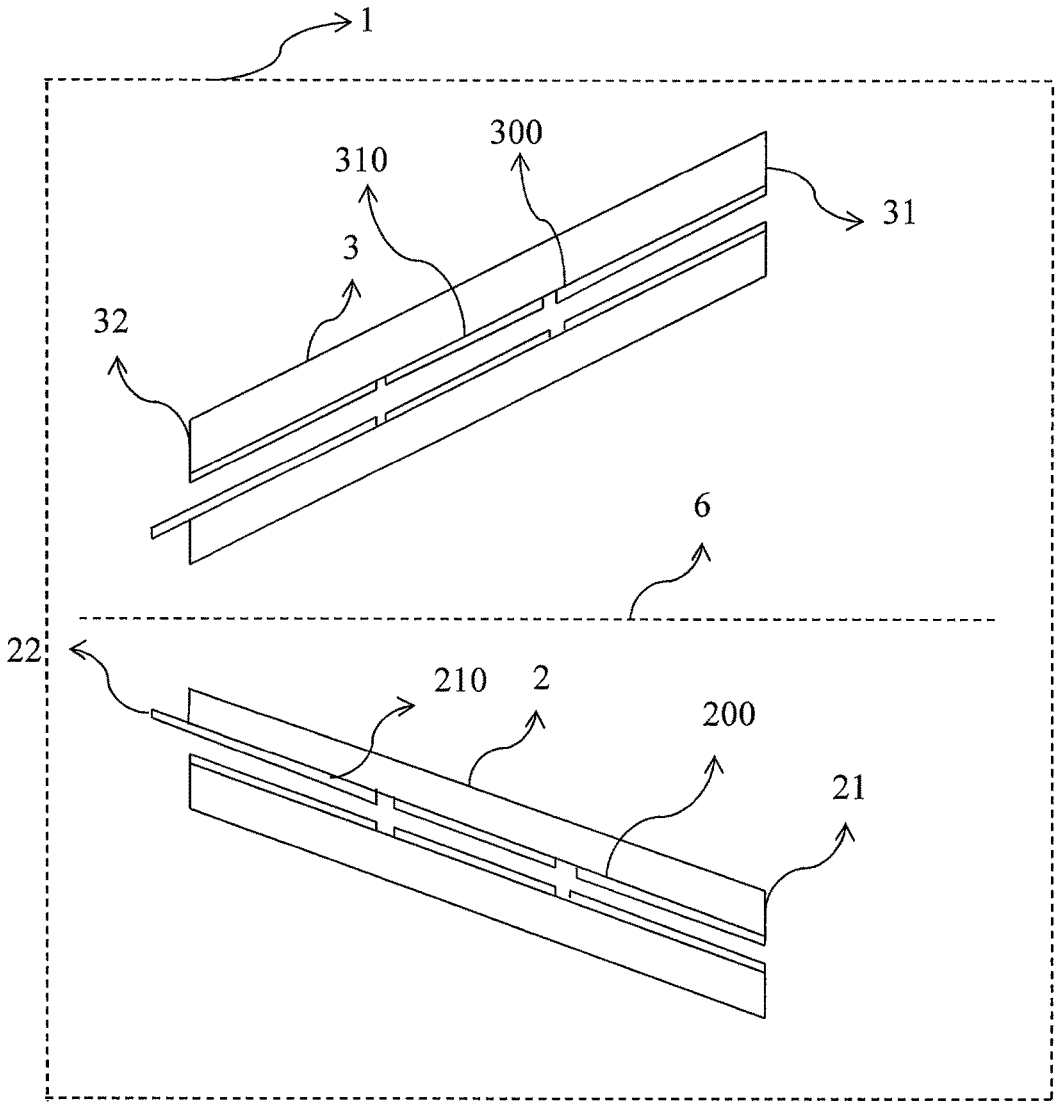
FIG. 6 is a schematic drawing of a cross-section of an exemplary embodiment of conically shaped refining blades for a refiner where the bars are provided in sections along the surfaces of the refining blades.

FIG. 6 shows a cross-section of a pair of conically shaped refining blades 2, 3 that are coaxially arranged around a common symmetry axis 6. There is also illustrated that bars 200, and bars 300 on the respective refining blades 2, 3 are provided in bands or sections 210, 310, respectively. That is, there is shown a pair of conically shaped refining blades 2, 3 for a refiner. The first 200 and second 300 bars are provided in sections 210, 310 on the respective refining blades. The bars 200, or a subset of these bars, of the section closest to the narrow end 22 of the cone extends further along the symmetry axis 6 in the direction of the tapering of said conical refining blades 2, 3 than the bars 300 of the corresponding section of the outer conical refining blade 3.

The arrangement of the refining blades is ready to be attached and used in a refiner. In one embodiment the outer refining blade 3 is provided in the refiner while the inner refining blade 2 is an attachable refining blade that is adapted to be coaxially arranged with aforementioned outer refining blade 3 and rotatable mounted to a shaft 4 in the refiner. The refining blade 2 is provided with bars 200 that, when the refining blade is attached and ready to be used, extend further along the symmetry axis 6, in the direction of the tapering of the cone than the outer conical refining blade 3 or the bars 300 thereof. This is illustrated by showing that the end point 22 of the bars of innermost section 210 of the inner refining blade 2 extends further than the endpoint 32 of the outer refining blade 3. An alternative embodiment have the inner refining blade 3 extending further than the outer refining blade 3, or the bars of the innermost section 310 of the outer refining blade 3. An inner refining blade 2 according to these embodiments can be added to existing refiners that are intended to be used with conically shaped refining blades without the need to alter the operational construction of the refiner.

Figure 7:
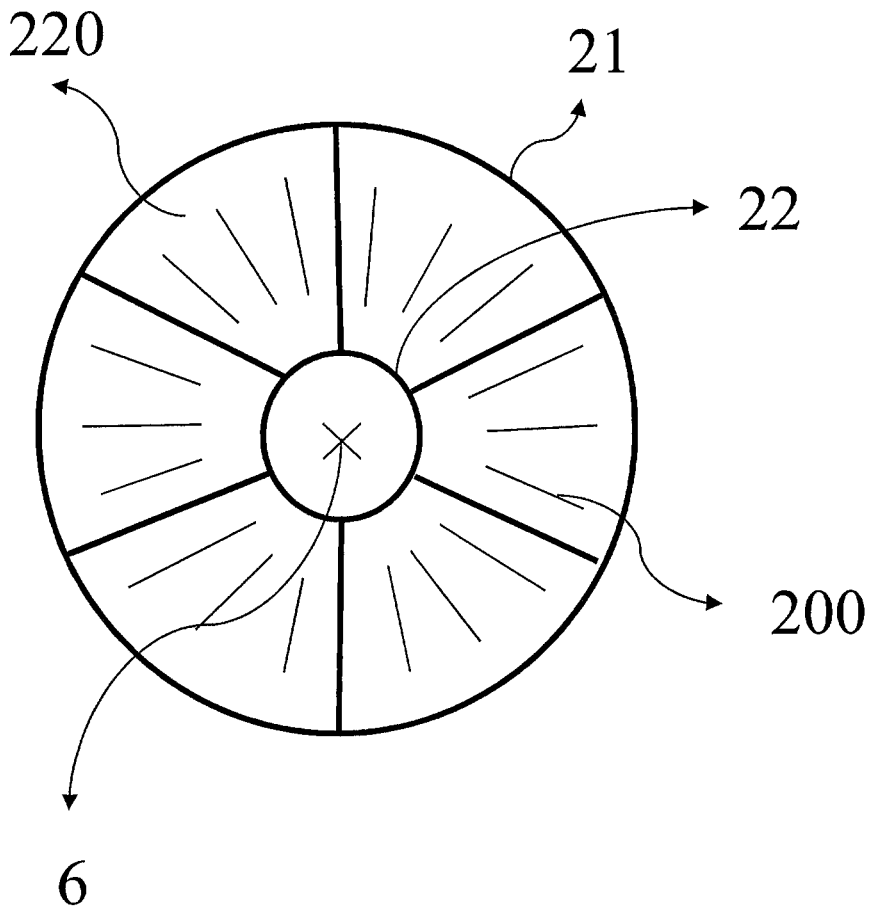
FIG. 7 is a schematic drawing showing a front view of a conically shaped refining blade where the bars of the refining blade are provided in segments.

FIG. 7 illustrates yet another alternative embodiment of an inner conically shaped refining blade 2 of a refiner. The surface of the refining blade 2 is illustrated in front view, as presented to the material flowing onto the refining blade 2. The refining blade 2 comprises a number of bar segments 220. These bar segments comprises in turn a number of bars 200 and are attached to the surface of the refining blade 2. The segments 220 extends between a base section 21 in the vicinity of the large end of the conical shape to a top section 22 in the vicinity of the narrow end of the cone. The bars 200 of the segments 220 of the inner conically shaped refining blade 2 might, according to a particular embodiment of the proposed design, extend further in the direction of the tapering of the cone than the outer conical refining blade 3 or the bars 300 provided on the outer conically shaped refining blade.

An inner refining element comprising the above described bar segments 220 provided with extended bars 200 could be fitted to already existing inner conically shaped refining blades 2 intended to be used in a refiner utilizing conically shaped refining blades without having to alter the operation of the refiner.

A pair of conical refining blades 2, 3 according to the proposed design could be fitted to existing refiners. In other words, a pair of conical refining blades 2, 3 could be fitted and used in a refiner 1. The pair of refining blades 2, 3 being configured to be coaxially arranged along a symmetry axis 6 to define an inner 2 and an outer 3 conical refining blade. The refining blades 2, 3 are provided with first 200 and second 300 bars, respectively, for grinding of fibrous material. At least a subset of the first bars 200 provided on the inner conical refining blade 2 extends further along the symmetry axis 6 in the direction of the tapering of the conical refining blades 2, 3 than the second bars 300 provided on the outer conical refining blade 3.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The invention claimed is:

1. A refiner comprising relatively rotatable inner and outer conical refining blades, said inner and outer conical refining blades being coaxially arranged around a symmetry axis and being provided with first bars and second bars, respectively, for grinding of fibrous material, any of the first bars of the inner conical refining blade extend further along the symmetry axis, in the direction of the tapering of said inner and outer conical refining blades, than the outer conical refining blade or any of the second bars of the outer conical refining blade, whereby debris contacts said any of the first bars of the inner conical refining blade so as to prevent debris from entering a refining gap between the inner conical refining blade and the outer conical refining blade.

2. The refiner according to claim 1, wherein the symmetry axis coincides with the direction of the feeding channel for fibrous material.

3. The refiner according to claim 1, wherein the innermost ends of the first bars in the direction of the tapering of said conical refining blade have a curved shape.

4. The refiner according to claim 3, wherein the first bars and the second bars run along the whole surface of said inner conical refining blade and outer conical refining blade, respectively.

5. The refiner according to claim 1, wherein the first bars and the second bars are provided in sections on the inner and outer conical refining blades respectively.

6. The refiner according to claim 1, wherein the inner and outer conical refining blades are arranged to be rotatable around the symmetry axis in opposite directions.

7. The refiner according to claim 1, wherein the inner conical refining blade is arranged to be rotatable around the symmetry axis while the outer conical refining blade is arranged to be fixed.

8. An attachable conical refining blade for a refiner, said refiner comprising an outer conical refining blade provided with second bars, wherein said attachable conical refining blade is provided with first bars and is configured to be rotatable and coaxially arranged with respect to said outer conical refining blade along a symmetry axis in such a way that the attachable conical refining blade forms an inner conical refining blade, any of said first bars of said attachable conical refining blade, when coaxially arranged with respect to said outer conical refining blade, extends further along the symmetry axis, in the direction of the tapering of said conical refining blades, than said outer conical refining blade or said second bars of said outer conical refining blade.

9. A pair of conical refining blades for use in a refiner, said pair of refining blades being configured to be coaxially arranged along a symmetry axis to define an inner and an outer conical refining blade and where said refining blades are provided with first bars and second bars, respectively, for grinding fibrous material, wherein at least a portion of the first bars provided on the inner conical refining blade extends further along the symmetry axis in the direction of the tapering of said conical refining blades than the second bars provided on the outer conical refining blade.

* * * * *